US010582768B1

(12) United States Patent
Ho

(10) Patent No.: US 10,582,768 B1
(45) Date of Patent: Mar. 10, 2020

(54) WORKING DESK WITH DISPLAY AND CARRYING BAG

(71) Applicant: Oxti Corporation, Taipei (TW)

(72) Inventor: Chih Feng Ho, Taipei (TW)

(73) Assignee: Oxti Corporation, Chungho, Taipei (TW)

( * ) Notice: Subject to any disclaimer, the term of this patent is extended or adjusted under 35 U.S.C. 154(b) by 0 days.

(21) Appl. No.: 16/223,180

(22) Filed: Dec. 18, 2018

(51) Int. Cl.
*A47B 21/00* (2006.01)
*A47B 21/007* (2006.01)
*A47B 21/04* (2006.01)

(52) U.S. Cl.
CPC ..... *A47B 21/0073* (2013.01); *A47B 21/04* (2013.01); *A47B 2200/008* (2013.01); *A47B 2200/0066* (2013.01)

(58) Field of Classification Search
CPC ... A47B 21/007; A47B 21/0073; A47B 21/04; A47B 2021/0076; A47B 2200/0066; A47B 2200/0067; A47B 2200/008
USPC ..... 108/50.02, 23, 25, 38
See application file for complete search history.

(56) References Cited

U.S. PATENT DOCUMENTS 6,286,440 B1 * 9/2001 Jyringi ..... A47B 21/00 108/50.01
6,553,919 B1 * 4/2003 Nevin ..... A47B 21/0073 108/25
6,601,931 B1 * 8/2003 Schairbaum ..... A47B 21/007 108/26
2004/0000258 A1 * 1/2004 Riddiford ..... A47B 21/00 108/50.01
2004/0150300 A1 * 8/2004 Wyatt ..... A47B 21/00 312/223.3
2006/0226742 A1 * 10/2006 Gevaert ..... A47B 21/0073 312/7.2
2006/0267952 A1 * 11/2006 Alcorn ..... A47B 21/007 345/173
2008/0143218 A1 * 6/2008 Alayev ..... A47B 21/0073 312/1
2009/0276319 A1 * 11/2009 Lungu ..... G06Q 30/02 705/14.73
2009/0284655 A1 * 11/2009 Lukes ..... A47B 21/007 348/552
2010/0116175 A1 * 5/2010 Pellegrini ..... A47B 21/0073 108/50.02
2011/0075337 A1 * 3/2011 Riley ..... A47B 21/0073 361/679.2
2012/0073478 A1 * 3/2012 Zhou ..... A47B 21/0073 108/42
2012/0250239 A1 * 10/2012 Cao ..... A47B 21/0073 361/679.21

(Continued)

*Primary Examiner* — Jose V Chen
(74) *Attorney, Agent, or Firm* — Charles E. Baxley

(57) ABSTRACT

A table combination includes a table plate supported on legs, the table plate includes a chamber, a displayer device is engaged in the chamber of the table plate and includes a connector, and a shield is engaged in the chamber of the table plate and disposed on the displayer device, and the shield includes an opening formed in the shield. A carrying bag is engaged in the opening of the shield. The carrying bag includes a housing having a base wall and an upper wall, and a cover panel is extended from the upper wall and foldable relative to the upper wall and movable toward the upper wall, a base plate is engaged in the housing, a support device is foldably attached to the base plate with a hinge device.

7 Claims, 6 Drawing Sheets

(56) References Cited

U.S. PATENT DOCUMENTS

| | | | | |
|---|---|---|---|---|
| 2014/0150233 | A1* | 6/2014 | Hussain | F16M 11/22 29/428 |
| 2014/0299025 | A1* | 10/2014 | Moita Gorgulho Soares Branco | A47B 21/007 108/50.02 |
| 2015/0293641 | A1* | 10/2015 | Chartier | A47B 21/007 345/173 |
| 2016/0260019 | A1* | 9/2016 | Riquelme Ruiz | A47B 21/007 |
| 2018/0014634 | A1* | 1/2018 | Pizzinato | A47B 13/003 |
| 2019/0125075 | A1* | 5/2019 | Soulliere | G06F 1/20 |
| 2019/0208902 | A1* | 7/2019 | Cao | A47B 13/088 |

* cited by examiner

WORKING DESK WITH DISPLAY AND CARRYING BAG

BACKGROUND OF THE INVENTION

1. Field of the Invention

The present invention relates to a working desk or table with monitor or displayer device, and more particularly to a working desk or table combination with a monitor or displayer device disposed or engaged therein for information displaying purposes, and/or having one or more compartments or chambers formed therein for accommodating or receiving packages or carrying bags which include an improved supporting shelf or placement rack for accommodating or receiving the displayer or the screen or the mobile device or the like.

2. Description of the Prior Art

Typical working desks or tables normally comprise a table top supported on four legs for supporting various objects, such as mobile devices, tablets, screens, laptops, notebooks, etc.

However, the typical working desks or tables have no compartments or chambers formed therein for accommodating or receiving mobile devices, tablets, screens, laptops, notebooks, or the like.

The present invention has arisen to mitigate and/or obviate the afore-described disadvantages of the conventional working desks or tables.

SUMMARY OF THE INVENTION

The primary objective of the present invention is to provide a working desk or table combination including a monitor or displayer device disposed or engaged therein for information displaying purposes.

The other objective of the present invention is to provide a working desk or table combination having one or more compartments or chambers formed therein for accommodating or receiving packages or carrying bags which include an improved supporting shelf or placement rack for accommodating or receiving the displayer or the screen or the mobile device or the like.

In accordance with one aspect of the invention, there is provided a table combination comprising a table plate supported on legs, the table plate including a chamber formed in the table plate, a displayer device engaged in the chamber of the table plate, the displayer device including a connector, and a shield engaged in the chamber of the table plate and disposed on the displayer device, and the shield including an opening formed in the shield for selectively receiving or engaging with a mobile device, a package or a container or a carrying bag therein.

A mobile facility or a carrying bag is received and engaged in the opening of the shield. The carrying bag includes a housing having a base wall and an upper wall, and a cover panel extended from the upper wall and foldable relative to the upper wall and movable toward the upper wall, a base plate is engaged in the housing, a support device is foldably attached to the base plate with a hinge device, and the support device is foldable relative to the base plate and the housing, a display attached to the support device and movable relative to the upper wall between an upwardly working position and a downwardly folded storing position, and the housing includes a depression formed in the upper wall for receiving and engaging with the display when the cover panel is folded toward the upper wall.

The housing includes a compartment formed therein and defined by the base wall and the upper wall, a mobile device is receiveable and engageable into the compartment of the housing, and a connecting cable is electrically connectable to the display and the mobile device, or to the connector of the displayer device. The base plate is engaged in the base wall of the housing for supporting the support device.

The housing includes a flap extended from the base wall and foldable relative to the base wall for covering the compartment of the housing selectively. The housing includes a lock device attached to the cover panel, and a lock member attached to the flap for selectively engaging with the lock device of the cover panel and for coupling the cover panel and the flap together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
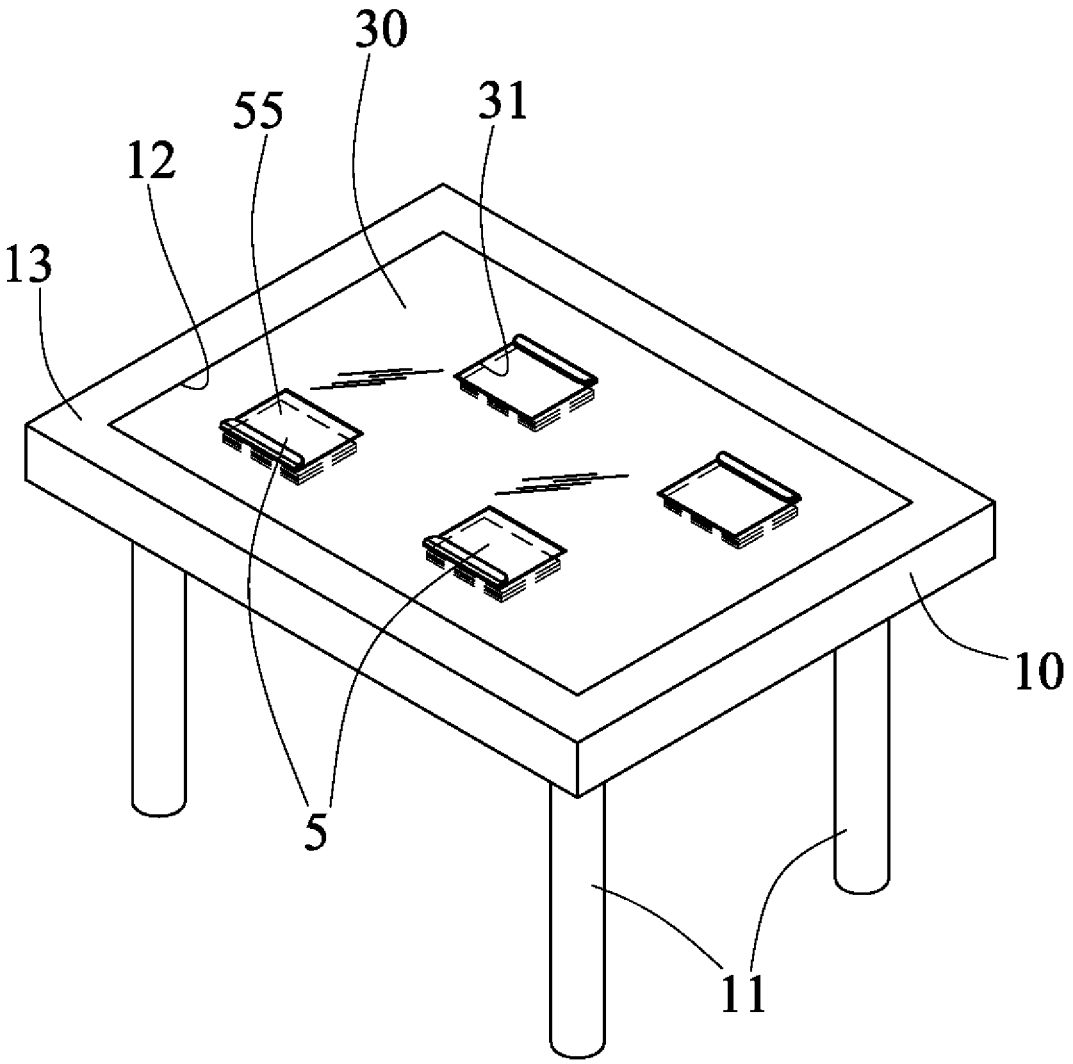
FIG. 1 is a perspective view of a working desk or table combination in accordance with the present invention, for supporting various objects, such as mobile devices, tablets, screens, laptops, notebooks, etc.

Referring to the drawings, and initially to FIGS. 1-4, a working desk or table combination in accordance with the present invention comprises a table plate or table top 10 supported on four legs 11, and the table plate 10 includes a recess or compartment or chamber 12 formed therein (FIG. 4), such as formed in the upper surface or upper portion 13 thereof for receiving or engaging with various objects, such as mobile devices, tablets, screens, laptops, notebooks, etc. For example, a screen or display or displayer device 20 is received or engaged in the chamber 12 of the table plate 10, and a cover or shield 30 is also received or engaged in the chamber 12 of the table plate 10 and disposed or engaged or supported on the displayer device 20, and preferably flush with the upper surface or upper portion 13 of the table plate 10.

The displayer device 20 includes a plug or connector 21 (FIG. 3) coupled or connected thereto for connecting or coupling to the other electric facilities, such as mobile devices, tablets, notebooks, computers, or the like for showing or display various information. The cover or shield 30 is made of transparent or semi-transparent materials or the like for allowing the information of the displayer device 20 to be seen or viewed through the transparent or semi-transparent shield 30. The shield 30 further includes one or more (such as four) recesses or openings 31 formed therein (FIGS. 3 and 4), and the openings 31 may be formed through the shield 30, or alternatively, do not be formed through the shield 30, for selectively receiving or engaging with mobile devices, packages or containers or carrying bags 5 (FIGS. 1, 2) therein.

Figure 5:
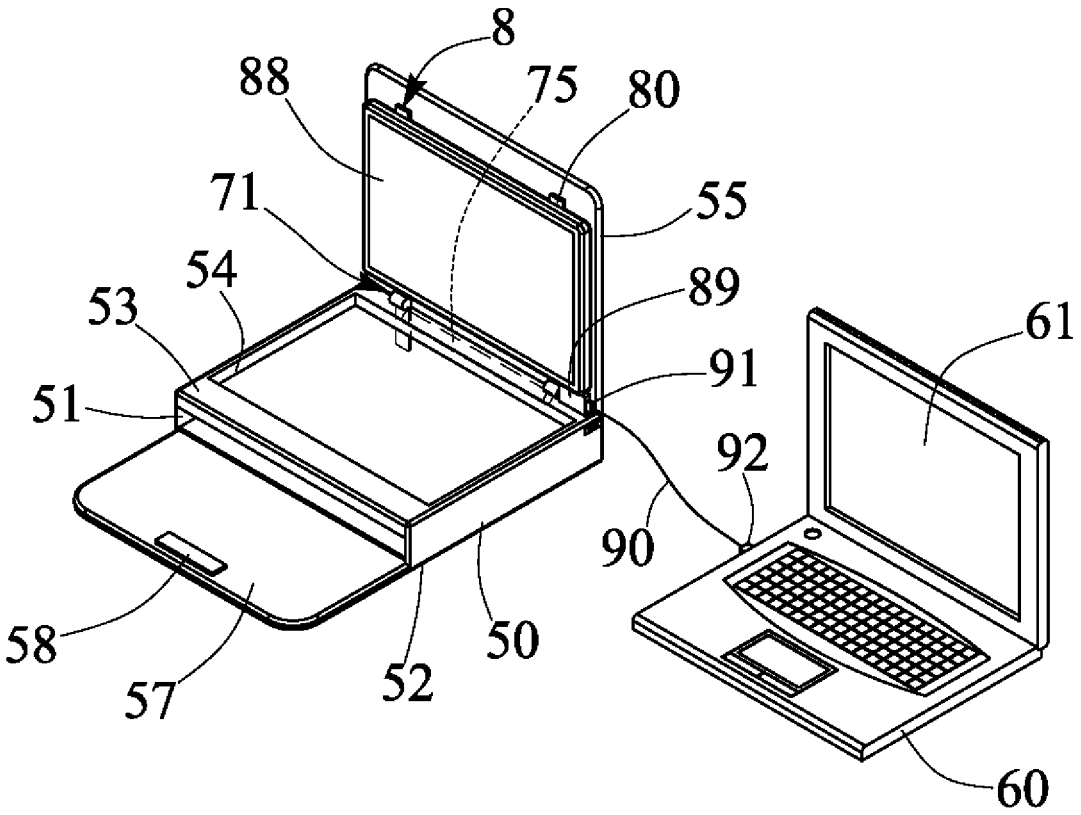
FIG. 5 is a perspective view illustrating the carrying bag for receiving the mobile device.
Figure 6:
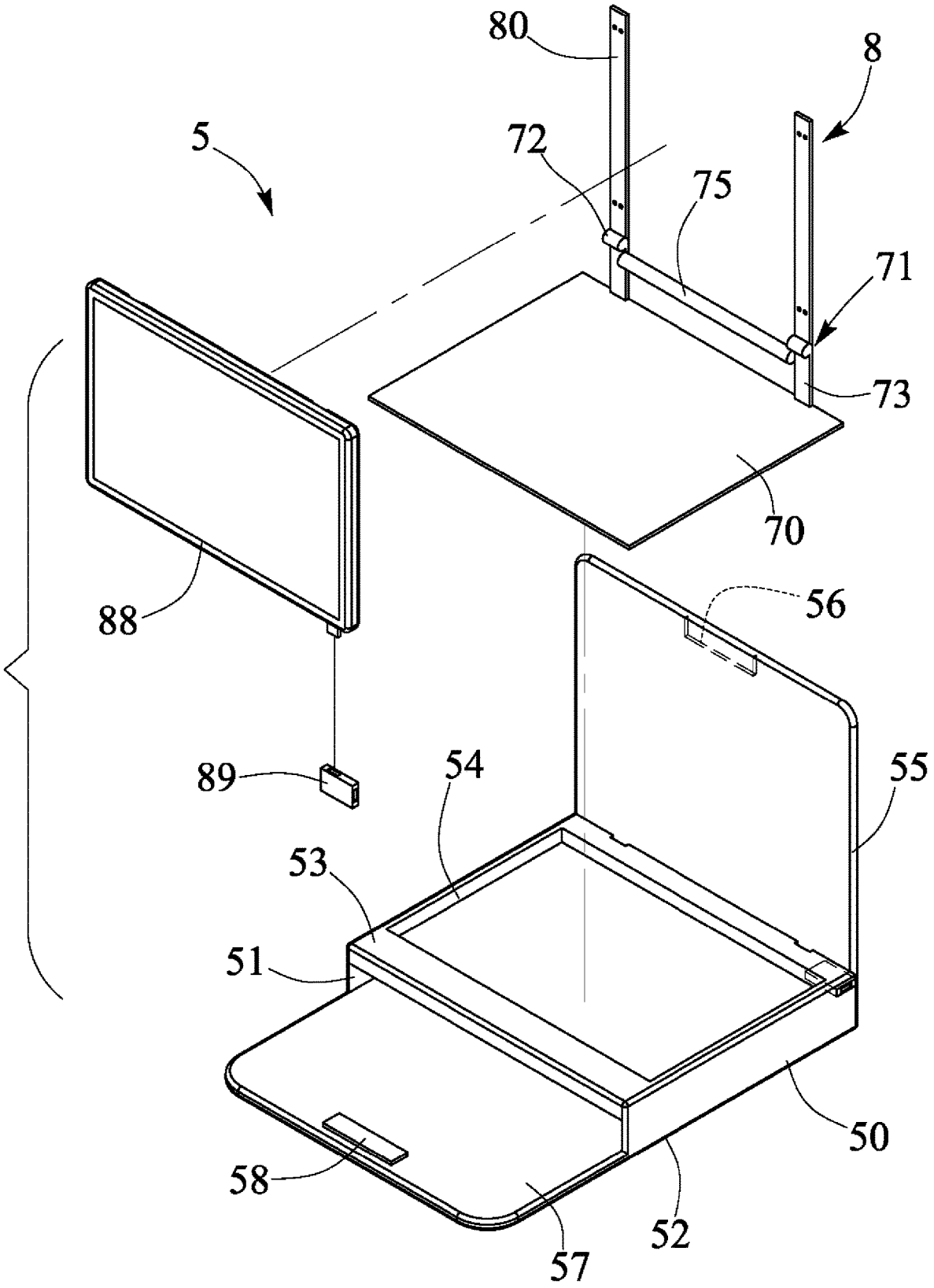
FIG. 6 is a partial exploded view illustrating the carrying bag for receiving the mobile device.

As shown in FIGS. 5 and 6, the carrying bags 5 each include a carrying bag body or housing 50 having a compartment or compartment 51 formed therein and formed or defined by a bottom or base wall 52 and an upper wall 53, and having a recess or depression 54 formed in the upper wall 53, the depression 54 that is formed in the upper wall 53 may be communicated with or spaced or separated from the compartment 51 of the housing 50. The housing 50 includes a cover panel 55 hinged or extended from the base wall 52 and/or the upper wall 53 and foldable relative to the upper wall 53 and/or foldable or movable toward the upper wall 53 for shielding or covering the depression 54 of the upper wall 53 of the housing 50 selectively.

The housing 50 further includes a lock device 56 such as a Velcro, a magic sticker or the like attached or mounted or secured to the cover panel 55, and further includes another fold or flap 57 hinged or extended from the base wall 52 and foldable relative to the base wall 52 and/or the upper wall 53, for covering the compartment 51 of the housing 50 selectively. The housing 50 further includes another lock device or lock member 58, such as a Velcro, a magic sticker or the like attached or mounted or secured to the flap 57, for selectively engaging with the lock device 56 of the cover panel 55, and for solidly and stably securing or coupling the cover panel 55 and the flap 57 together. The compartment 51 of the housing 50 may be provided for accommodating or receiving or containing a mobile facility or mobile device 60 (FIGS. 4-6), such as a tablet, a laptop, a screen, a notebook, or the like.

As also shown in FIGS. 5 and 6, a weight member of base plate 70 (FIG. 6) is received or engaged into the base wall 52 of the housing 50, and disposed or located below the compartment 51 of the housing 50, a placement rack or support device 8 is foldably attached or mounted or secured to the base plate 70 with a pivot or hinge device 71 and foldable relative to the base plate 70, for example, the support device 8 includes a stay or board or carrier 80 pivotly or foldably attached or mounted or secured to the base plate 70 with a hinge member 72 of the hinge device 71 and foldable relative to the base plate 70, the carrier 80 of the support device 8 are contacted or engaged or attached or mounted or secured to the cover panel 55 and foldable or movable in concert with the cover panel 55 relative to the base plate 70 and the base wall 52 and/or the upper wall 53.

A screen or display 88 is attached or mounted or secured to the carrier 80 of the support device 8 and foldable or movable relative to the base wall 52 and/or the upper wall 53 between an upwardly or working position as shown in FIG. 5, and a downwardly folded storing position. It is preferable that the display 88 is received or engaged into the depression 54 of the upper wall 53 of the housing 50 when the cover panel 55 and the carrier 80 of the support device 8 are folded or moved toward the upper wall 53. When or after the mobile device 60 is received or engaged into the compartment 51 of the housing 50 and when the cover panel 55 and the carrier 80 of the support device 8 are folded or moved toward the upper wall 53, the flap 57 may be folded relative to the base wall 52 and/or the upper wall 53, and the lock member 58 of the flap 57 may be engaged with the lock device 56 of the cover panel 55, for solidly and stably securing or coupling the cover panel 55 and the flap 57 together and for solidly and stably anchoring or retaining the mobile device 60 within the compartment 51 of the housing 50.

As shown in FIG. 5, when the mobile device 60 is removed or disengaged from the compartment 51 of the housing 50, the mobile device 60 may be electrically connected or coupled to the terminal or connecter 89 of the display 88 with a connecting cable 90 and one or more connecters or couplers 91, 92, for allowing the information of the mobile device 60 to be shown in either or both the display 88 and the screen 61 of the mobile device 60, and/or in the displayer device 20. The connecter 89 of the display 88 may be selected from a USB type C connecter, a Miracast, an Airplay, an AiDi, a Chromecast, or a DLNA, or the like. Similarly, the mobile device 60 may also be electrically connected or coupled to the terminal or connecter 89 of the display 88 wirelessly.

Figure 2:
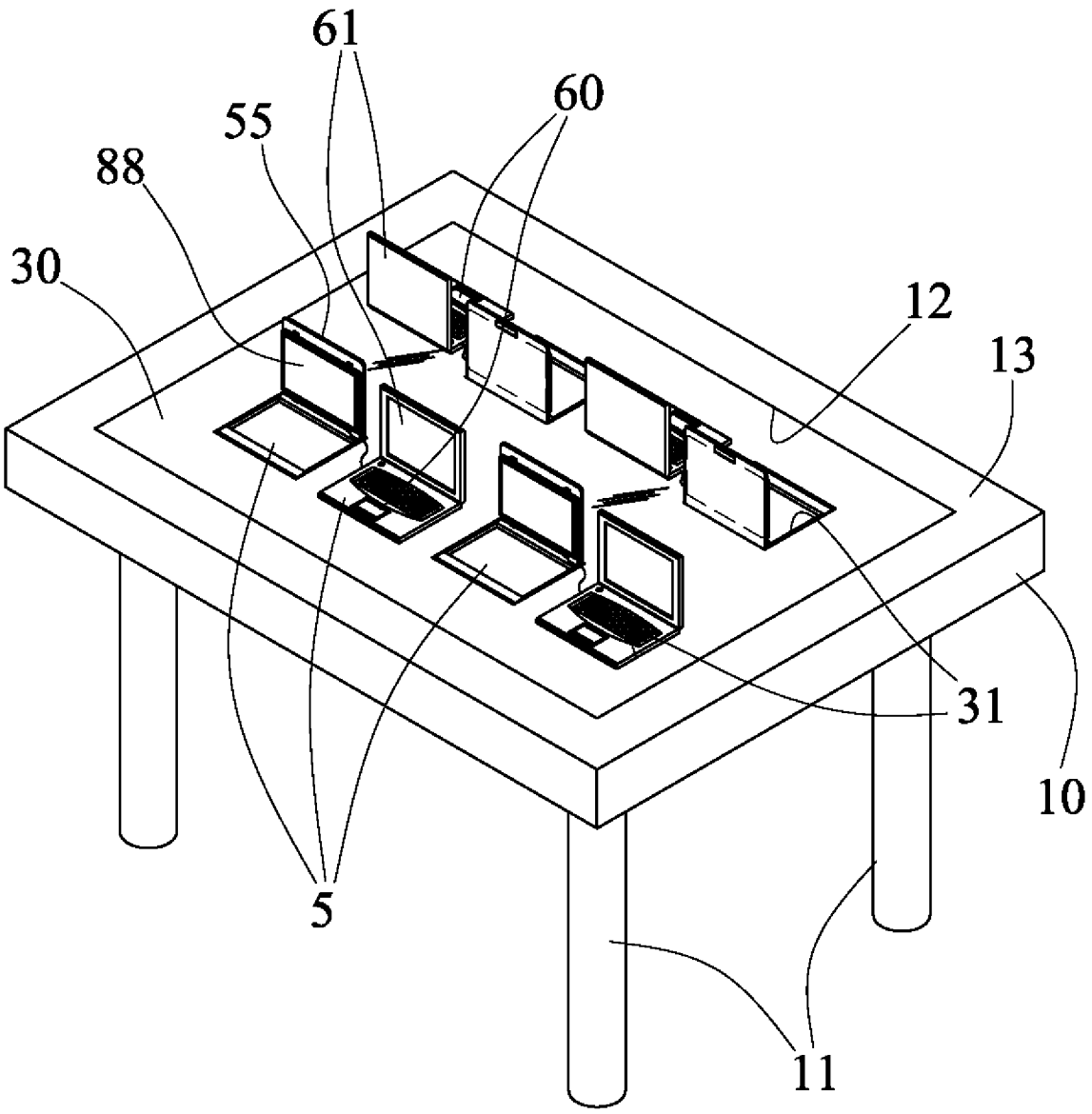
FIG. 2 is another perspective view similar to FIG. 1, illustrating the operation of the table combination for supporting mobile devices.
Figure 3:
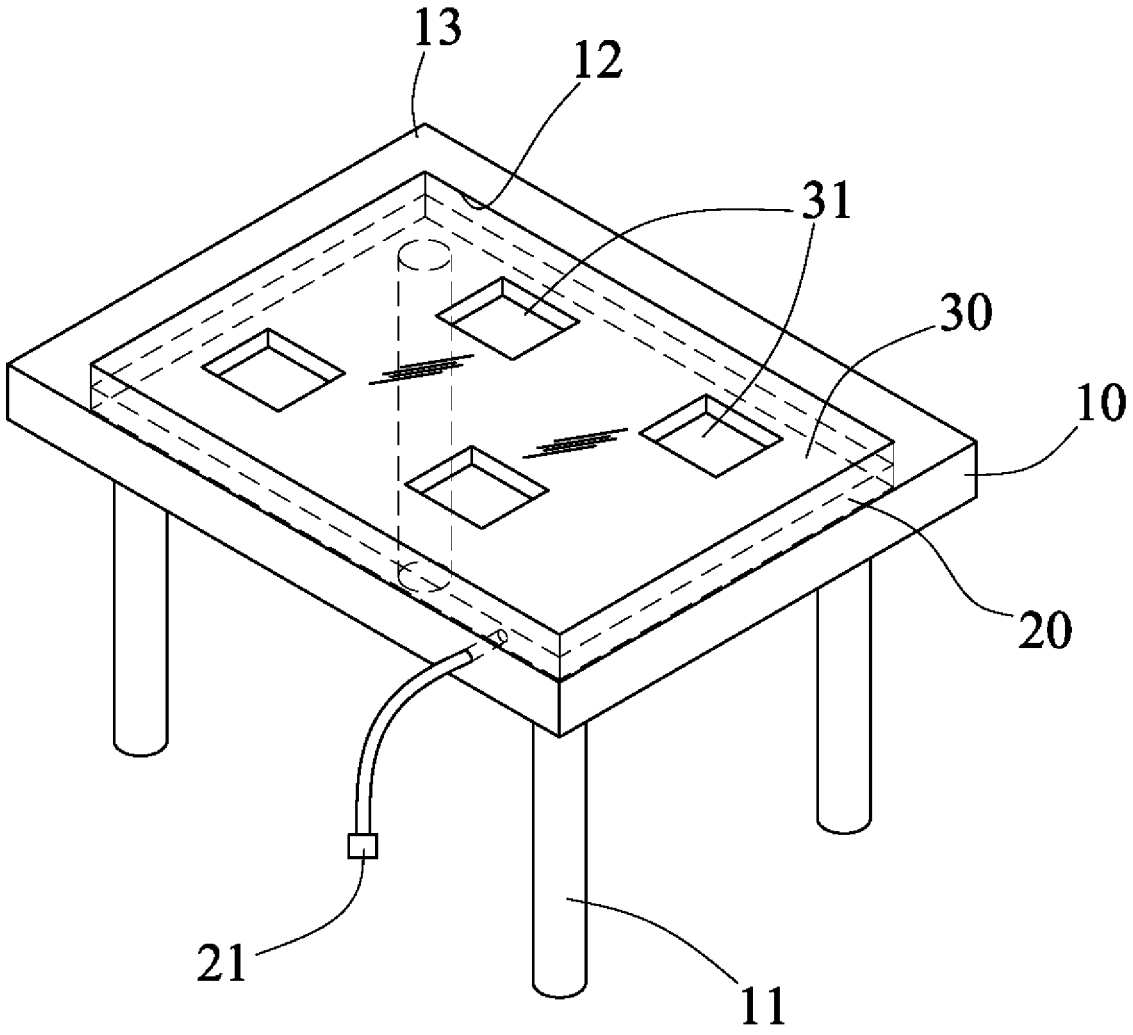
FIG. 3 is a further perspective view similar to FIGS. 1 and 2, illustrating the operation of the table combination for supporting mobile devices.
Figure 4:
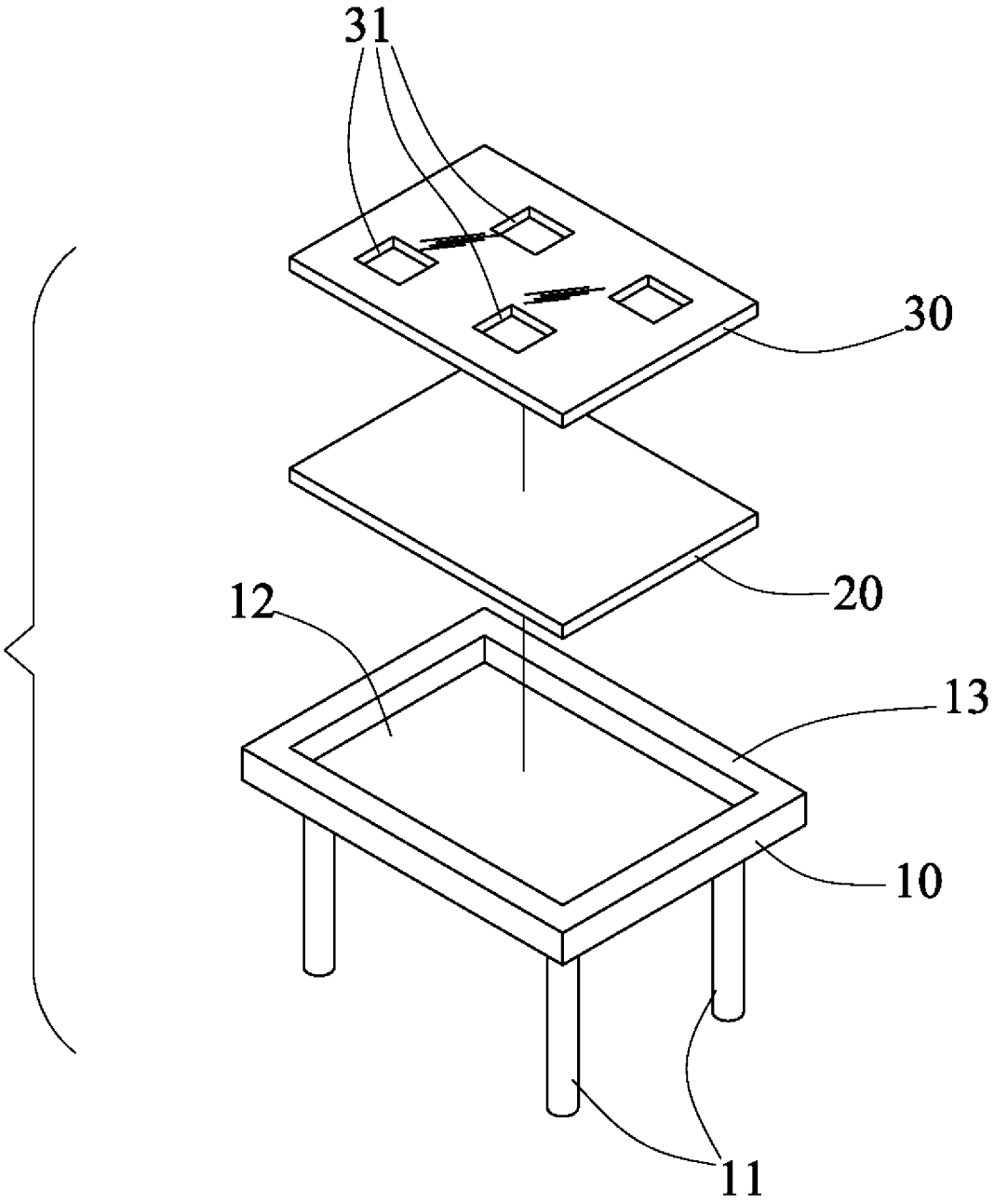
FIG. 4 is a partial exploded view of the table combination for supporting mobile devices.

In operation, as shown in FIGS. 1-2 and 5, the display 88 and the cover panel 55 and the carrier 80 of the support device 8 may be folded relative to the base wall 52 and/or the upper wall 53 upwardly toward the opening or working position for allowing the display 88 reached or operated by the user. After use, the display 88 and the cover panel 55 and the carrier 80 of the support device 8 may be folded relative to the base wall 52 and/or the upper wall 53 downwardly toward the upper wall 53 to the folded storing position, for allowing the display 88 to be received or engaged into the depression 54 of the upper wall 53 of the housing 50. After the mobile device 60 is received or engaged into the compartment 51 of the housing 50, the flap 57 may be folded relative to the base wall 52 and/or the upper wall 53, and the lock member 58 of the flap 57 may be engaged with the lock device 56 of the cover panel 55, for solidly and stably securing or coupling the cover panel 55 and the flap 57 together and for solidly and stably anchoring or retaining the mobile device 60 within the compartment 51 of the housing 50.

As shown in FIG. 6, a power supply or battery 75 may further be provided and disposed or engaged into the chamber 11 of the housing 10, and preferably disposed or engaged between the extensions 73 of the base plate 70, and the power supply or battery 75 may be selected from a tube form battery, an ultra-thin flat battery, or a lithium battery, or the like, for selectively and electrically connecting or coupling to various mobile members (not illustrated) and for selectively charging the mobile members with wires or wirelessly. In operation, the display 88 and the cover panel 55 and the carrier 80 of the support device 8 may be folded relative to the base wall 52 and/or the upper wall 53 upwardly toward the opening or working position for allowing the display 88 reached or operated by the user. In addition, while using or operating the display 88 and/or the mobile device 60, the displayer device 20 may also be operated by the user easily and simultaneously.

Accordingly, the working desk or table combination in accordance with the present invention includes a monitor or displayer device disposed or engaged therein for information displaying purposes, and includes one or more compartments or chambers formed therein for accommodating or receiving packages or carrying bags which include an improved supporting shelf or placement rack for accommodating or receiving the displayer or the screen or the mobile device or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A table combination comprising:

a table plate supported on legs, said table plate including a chamber formed in said table plate, a displayer device engaged in said chamber of said table plate, said displayer device including a connector, a shield engaged in said chamber of said table plate and disposed on said displayer device, and said shield including an opening formed in said shield, and a carrying bag received and engaged in said opening of said shield.

2. The table combination as claimed in claim 1 further comprising a mobile facility received and engaged in said opening of said shield.

3. The table combination as claimed in claim 1, wherein said carrying bag includes a housing having a base wall and an upper wall, and a cover panel extended from said upper wall and foldable relative to said upper wall and movable toward said upper wall, a base plate is engaged in said housing, a support device is foldably attached to said base plate with a hinge device, and said support device is foldable relative to said base plate and said housing, a display attached to said support device and movable relative to said upper wall between an upwardly working position and a downwardly folded storing position, and said housing includes a depression formed in said upper wall for receiving and engaging with said display when said cover panel is folded toward said upper wall.

4. The table combination as claimed in claim 3, wherein said housing includes a compartment formed in said housing and defined by said base wall and said upper wall, a mobile device is receiveable and engageable into said compartment of said housing, and a connecting cable is electrically connectable to said display and said mobile device.

5. The table combination as claimed in claim 3, wherein said base plate is engaged in said base wall of said housing.

6. The table combination as claimed in claim 3, wherein said housing includes a flap extended from said base wall and foldable relative to said base wall for covering said compartment of said housing selectively.

7. The table combination as claimed in claim 6, wherein said housing includes a lock device attached to said cover panel, and a lock member attached to said flap for selectively engaging with said lock device of said cover panel and for coupling said cover panel and said flap together.

* * * * *